United States Patent [19]

Kingsley

[11] 3,982,831

[45] Sept. 28, 1976

[54] ELECTROSTATOGRAPHIC REPRODUCTION APPARATUS AND DRIVE THEREFOR

[75] Inventor: William Kingsley, Rochester, N.Y.

[73] Assignee: Xerox Corporation, Stamford, Conn.

[22] Filed: June 30, 1975

[21] Appl. No.: 592,004

[52] U.S. Cl. ..... 355/5; 355/8; 355/51

[51] Int. Cl.[2] ..... G03G 15/04

[58] Field of Search ..... 355/3 R, 3 DR, 3 BE, 355/4, 5, 8, 11, 18, 47–51, 44, 45, 84; 346/74 CR, 74 ES, 110 R; 178/6.6 A

[56] References Cited

UNITED STATES PATENTS

| | | | |
|---|---|---|---|
| 3,155,022 | 11/1964 | Schwertz | 355/5 |
| 3,442,586 | 5/1969 | Coil et al. | 355/45 X |
| 3,697,165 | 10/1972 | Morriston et al. | 355/8 |
| 3,775,008 | 11/1973 | Schaeffer et al. | 355/18 |
| 3,778,149 | 12/1973 | Fields | 355/16 |
| 3,900,258 | 8/1975 | Hoppner et al. | 355/8 X |

*Primary Examiner*—Joseph F. Peters, Jr.
*Assistant Examiner*—Kenneth C. Hutchison
*Attorney, Agent, or Firm*—James J. Ralabate; Michael H. Shanahan; Max J. Kenemore

[57] ABSTRACT

Automatic electrostatographic reproduction apparatus in which an image to be reproduced is moved during imaging thereof on to a moving photoconductive plate. The apparatus includes a simple and effective drive for the image carrier. The drive is particularly suited for use in apparatus incorporating an intermediate image storage device as the image carrier to enable signal encoded images, the components of which are displayed sequentially, to be stored and displayed in a format acceptable to the electrostatographic processor. The drive permits the image carrier to be driven synchronously with the photoconductive plate while enabling the image carrier to be held stationary without interrupting the reproduction process. Thus the image storage device may, following scanning thereof, be held stationary for receiving and storing a fresh image while the previous image is still being treated in the electrostatographic processor.

24 Claims, 6 Drawing Figures

ELECTROSTATOGRAPHIC REPRODUCTION APPARATUS AND DRIVE THEREFOR

BACKGROUND OF THE INVENTION

This invention relates to electrostatographic reproduction apparatus and is particularly concerned with such apparatus for reproducing signal encoded images exhibited on a display surface in an automatic mode of operation.

In one well-known form of automatic electrostatographic reproduction apparatus, a moving photoconductive plate [photoreceptor] generally in the form of an endless surface, such as a drum, belt or the like, is first uniformly charged and the surface then exposed to a light pattern of the image sought to be reproduced thereby to discharge the charge in the areas where light strikes the plate. The undischarged areas of the plate thus form an electrostatic charge pattern in conformity with the configuration of the original image pattern. This electrostatic latent image may then be developed in visible form by applying a developer material to the plate using any one of a number of development means generally known and used in the art. Subsequent to the development operation, the now visible image is transferred from the plate to a sheet of final support material such as paper of the like and suitable affixed to it thereby forming a permanent print. One example of such a machine is described and illustrated in U.S. Pat. No. 3,640,615. This machine incorporates a stationary platen for an original document to be copied and an optical projection system for projecting an image of the document onto the photoconductive plate, which system has a moving mirror for scanning the document. As the mirror scans across the document the image is projected onto the photoreceptor, the movement of which is synchronized with that of the mirror. Instead of the miror being moved during scanning the document itself may be moved for example by mounting it on a reciprocating carriage.

It is known in the prior art to provide a display device, such as cathode ray oscilloscope, for the display of signal encoded data. The optical display can then be imaged onto a photoreceptor of an electrostatographic reproduction machine for example as described in U.S. Pat. No. 3,673,936. However, it is frequently desirable to encode an image in signals which are not efficiently utilized by the typical automatic electrostatic reproduction device of the kind described above in which the photoconductive plate is in motion during exposure. Such apparatus are typically geared for scanning an optical image media exhibited in its entirety at one time. The components of a signal encoded image are more efficiently displayed sequentially. In order to reproduce such images on an electrostatographic reproduction device of the kind described above it would be necessary to halt the device while the image is displayed on the display surface or in the alternative it would be necessary to provide extensive signal processing to produce the image as a scanning format on the display so that it can be utilized by the electrostatographic reproduction apparatus without halting it. However, the latter requires additional and frequently complex processing of the signals encoding the image and, particularly if the display device is a cathode ray oscilloscope, it is necessary to include apparatus for maintaining the image during scanning by the optical projection system of the apparatus.

The use of an image storage device, such as a photoconductive liquid crystal sandwich, in conjunction with an electrostatographic reproduction apparatus has been proposed for temporarily storing an image to be reproduced, this stored image then being imaged onto the photoconductive plate of the apparatus. One example of such use of an image storage device is to be found in U.S. Pat. No. 3,778,149.

As described above one way of exposing a photoconductive plate of an automatic electrostatographic reproduction apparatus to an image to be reproduced is to utilize a stationary optical system and means for moving the image carrier for scanning the image. However where such an image carrier is an intermediate image storage service which is to be exposed to information displayed sequentially on a display surface, it is necessary for the device to be held stationary during this exposure. During imaging onto the photoconductive plate it is important that the image carrier be moved synchronously with the photoconductive plate but the imaging step is completed before the completion of other steps in the electrostatographic process such as development, transfer and fixing. Accordingly it is desirable for the image carrier to be brought to a stationary position while the photoconductive plate is still moving. Various mechanisms for achieving this in electrostatographic reproduction machines having document scanning carriages have been proposed such as in U.S. Pat. No. 3,697,165 but these have tended to be rather complicated.

SUMMARY OF THE INVENTION

It is therefore an object of this invention to provide an electrostatographic reproduction apparatus employing a simple and effective drive for an image carrier which is moved during imaging.

It is another object of the invention to provide such an apparatus in which the drive may be disengaged for holding the image carrier stationary without interrupting the reproduction process.

It is a further object of the invention to provide an improved automatic electrostatographic reproduction apparatus for reproducing signal encoded images.

It is a still further object of the invention to provide such apparatus employing an image storage device for storing temporarily an image produced by a display device exhibiting a signal encoded image, the stored image being capable of thereafter being imaged on to a photoconductive plate.

These and other objects of the invention are achieved by a drive for the scanning carriage which includes a control element driven in synchronism with the photoconductive plate for controlling the movement of the scanning carriage. The drive is maintained engaged by suitable means and a release mechanism is provided which is actuable to deactivate the drive engaging means whereupon a biasing means is operable to disengage the drive intermediate the control element and the carriage and to urge the carriage into a stationary position. To reengage the drive the release mechanism is deactuated.

DESCRIPTION OF THE DRAWINGS

In order that the invention may be more readily understood, reference will now be made to the accompanying drawings, in which.

DESCRIPTION OF THE PREFERRED EMBODIMENTS

Figure 1:
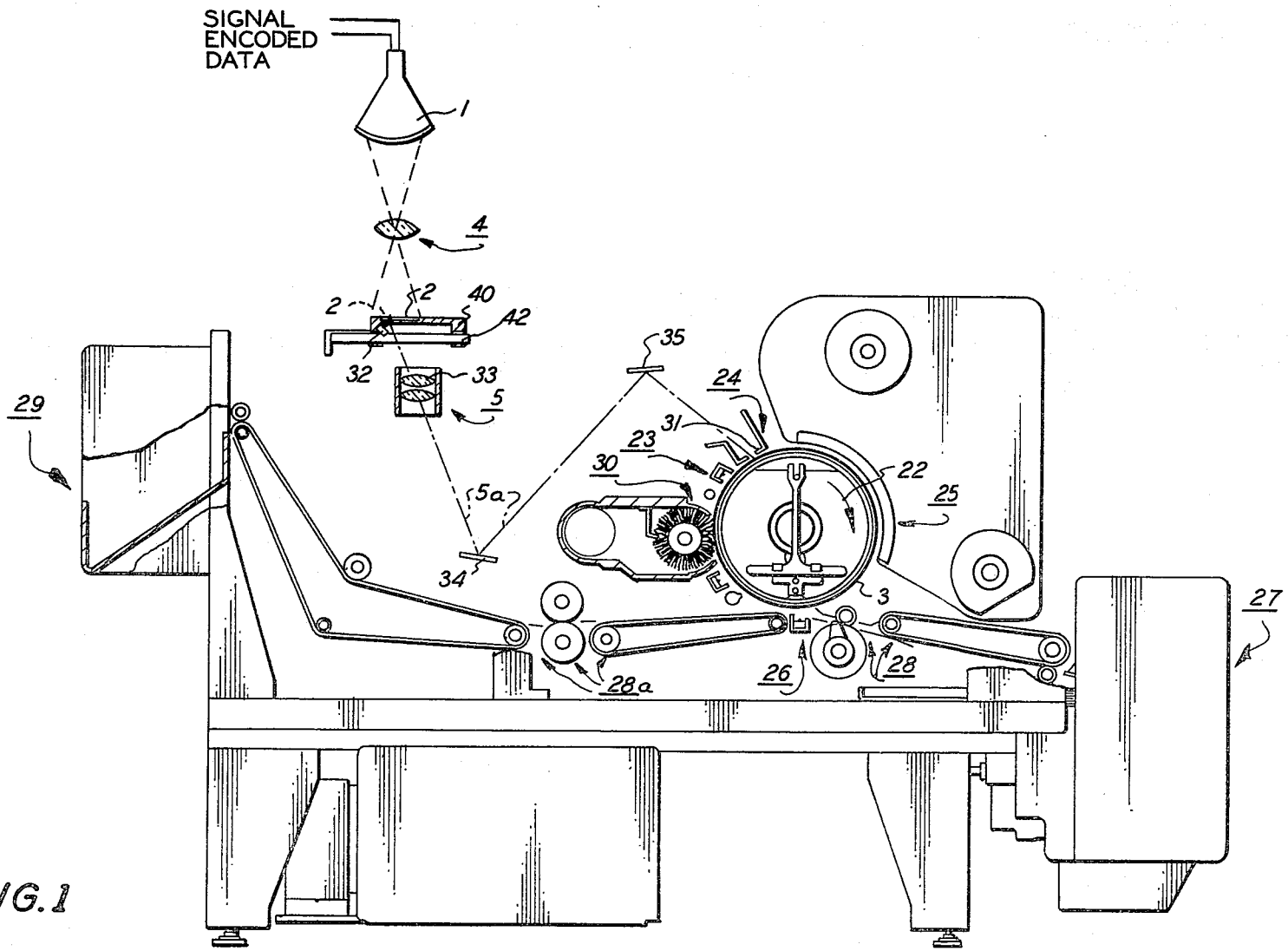
FIG. 1 is a schematic representation of one embodiment of automatic xerographic reproduction machine in accordance with the invention.

Referring now to the drawings, there is illustrated one embodiment of automatic xerographic reproduction machine in accordance with the invention for xerographically reproducing a signal encoded image exhibited on a display screen through the intermediary image storage device. In general, as shown in FIG. 1, the apparatus comprises a screen 1 for exhibiting the signal encoded image, an image storage device 2 for receiving and storing the image temporarily in visible form, and a xerographic plate 3 arranged for exposure to the image stored in the image storage device 2. A first optical projection system, schematically represented by the lens 4, is provided for imaging the signal encoded image on to the image storage device 2 and a second optical exposure system 5 is provided for exposing xerographic plate 3 to the stored image. The xerographic plate 3 has associated with it the usual xerographic processing stations for charging, development, transfer, fixing and the like for producing a permanent print of an image to be reproduced on a sheet of support material.

The component parts and assemblies of the machine generally described above will now be dealt with in greater detail.

The image storage device 2 must be capable of receiving and storing an optical image in visible form suitable for subsequent imaging onto the xerographic plate 3. One device suitable for this purpose is a photoconductive-liquid crystal storage device. The construction and operation of such devices are well known in the art and the preferred form of image storage device employed in the illustrated embodiment will only briefly be described with reference to FIGS. 2 and 3.

Figure 2:
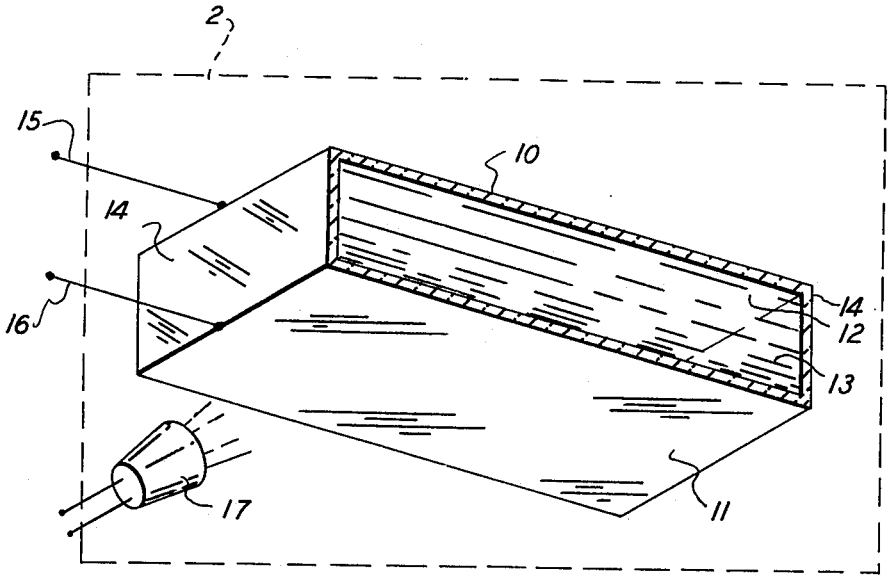
FIG. 2 is a schematic view of one form of image storage device suitable for use in the machine shown in FIG. 1.

As shown in FIG. 2, the image storage device 2 comprises transparent conducting windows 10 and 11 each formed of transparent insulating material having a thin conducting layer applied on only the inwardly, facing surface. Deposited on conducting window 10 is a photoconductive material 12. A liquid crystal material 13 is located between photoconductive material 12 and window 11. An insulating material 14 provides structural support for the windows 10 and 11 and provides an enclosure for the liquid crystal material 13. Windows 10 and 11 are coupled respectively to conducting leads 15 and 16. A source of illumination 17 is also provided.

The operation of the image storage device 2 can be understood as follows. The liquid crystal utilized in the preferred embodiment contains two components. One component produces a current-induced scattering of applied radiation. The second component provides a material which impedes the current-induced optical scattering mechanism from relaxing and disappearing. When a voltage is applied between windows 10 and 11, i.e., via electrical couplings 15 and 16, the insulating properties of photoconductor 12, in the absence of applied radiation, prevent current from flowing in the liquid crystal. However, when radiation is applied in a local region of the photoconductor, the insulating property is altered and the photoconductor becomes conducting in the region of applied radiation and voltage applied between windows 10 and 11 is now applied between photoconductive material 12 and window 11 across the liquid crystal 13, causing a current to flow and optical scattering to be produced. When the spacing between window 11 and photoconductive material is sufficiently small, the flow of current will be confined to a localized region. Upon removal of the voltage between conducting leads 15 and 16, the local optical scattering will remain. When the image storage device 2 is now illuminated with a generalized or flooding radiation, the optical scattering centers will scatter the applied radiation while in the region of insignificant optical scattering, the flood illumination will be reflected. Thus, as will be clear to those skilled in the art, by proper positioning of flood illumination and aperture stops, an image determined by the illumination in the presence of applied voltage can be produced. Thus the image storage device 2 provides the mechanism for storing an optical image along with the ability to display that image in visible form.

Figure 3:
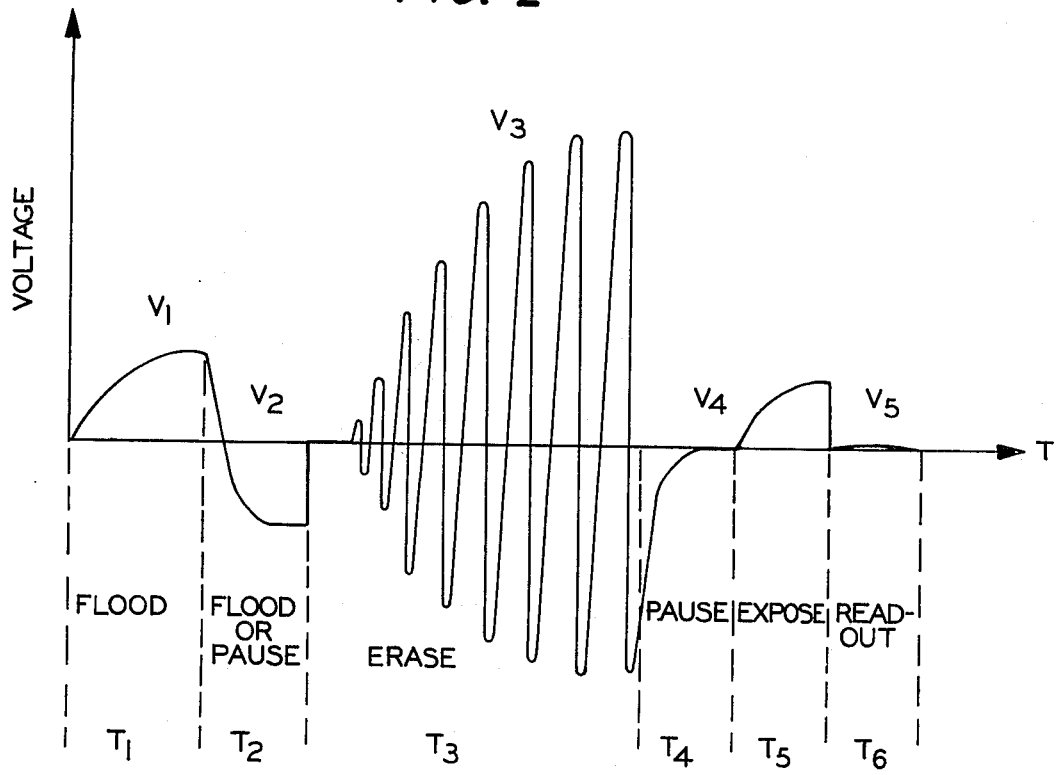
FIG. 3 is a voltage diagram indicating the voltages utilized to operate the image storage device shown in FIG. 2.

Referring now to FIG. 3 the potential voltage applied to conducting leads 15 and 16 of the liquid crystal cell during a typical operating cycle is shown. During a period $T_1$, in the presence of flood illumination, a gradually increasing voltage $V_1$ is applied. This period provides a uniform optical scattering of the entire liquid crystal cell, so that after erasure of the scattering, any residual scattering will be uniform over the entire cell. During period $T_2$ a negative voltage $V_2$ is gradually applied to the cell in the presence of flood illumination. The use of reverse current can, for some liquid crystal materials, prolong the useful lifetime. However, some materials do not require the application of a negative voltage and for these materials a pause with no applied voltage can be utilized during period $T_2$. During period $T_3$ an oscillating voltage $V_3$ of gradually increasing magnitude in a preselected frequency range is applied to conducting leads 15 and 16. The result of this oscillating voltage application is the removal of a majority of the optical scattering centers in the liquid crystal. The time period $T_4$ provides a wait period including the absence of applied voltage and flood illumination. During period $T_5$, a gradually increasing voltage $V_4$ is applied between conducting leads 15 and 16, in the absence of flood illumination. During this time interval, the cell is exposed to and stores the optical image to be reproduced. During period $T_6$, a substantially null voltage $V_5$ is applied to conducting leads 15 and 16. During this period, the flood illumination or other illumination source can provide a display of stored image and the image focused on to the xerographic plate 3.

It will be understood that a suitable electrical control is to be provided for controlling the operation of the liquid crystal storage device. Suitable electrical control systems will be apparent to those skilled in the art but for the purposes of illustration, reference may be made to the electrical control described and illustrated in copending application No. 591,800 of Adams et al. entitled Apparatus and Method For Intermediate Image Storage Device Precollation In Electrostatographic Processing Machines assigned to the same assignee as the present application.

Turning now to the xerographic processor of the illustrated apparatus, the xerographic plate 3 has a photoconductive layer or photosensitive surface on a conductive backing and takes the form of a drum which is journalled in a frame on a shaft 21 for rotation in the direction indicated by the arrow 22 to sequentially pass a series of xerographic processing stations. For the purpose of the present disclosure, the several xerographic processing stations in the path of movement of the plate surface may be described functionally as follows:

A charging station 23 at which a uniform electrostatic charge is deposited on the photoconductive plate 3.

An exposure station 24 at which a light or radiation path of an image on the storage device 2 is projected by means of the optical projection system 5 on to the plate surface to dissipate the charge in the exposed areas thereof to form a latent electrostatic image on the plate. reproduced.

A developing station 25 at which xerographic developer material, including toner particles having electrostatic charge opposite to that of the latent electrostatic image, is presented to the plate surface whereby the toner particles adhere to the latent electrostatic image to form a toner powder image in configuration of the image being produced.

A transfer station 26 at which the toner powder image is electrostatically transferred from the plate surface to a transfer material or a sheet of final support material such as paper. As shown copy paper is fed in sheet form from a supply arranged in housing 27 by the sheet transport system 28. Following transfer the copy sheet is fed away to an output tray 29 by a continuation 28*a* of the sheet transport 28.

A drum cleaning and discharge station 30 at which the plate surface is brushed to remove residual toner particles remaining thereon after image transfer and exposed to a relatively bright light source to effect substantially complete discharge of any residual electrostatic discharge remaining thereon.

In operation of the xerographic processor, the xerographic drum 3 is rotated and the image storage device 2 carrying an image to be reproduced is scanned incrementally at a rate such that the optical image is projected on to the drum through a slit 31 at a predetermined rate relative to the rotational speed of the drum. The optical scanning or projection system 5 comprises a lamp 32, lens 33 and mirrors 34 and 35 which are all stationary. Therefore, in order to project a flowing image onto the drum as described above, it is necessary for the image storage device 2 to be moved passed the optical path 5*a* of the projection system 5 to scan the image. To this end the image storage device 2 is mounted on a carriage 40 supported for sliding movement on a pair of rails 41 and 42 secured to the frame of the machine. A suitable drive system in accordance with this invention for driving the carriage 40 during scanning will now be described.

It will be understood from the foregoing that when exposing the image storage device to a signal encoded image, the components of which are displayed sequentially, it is necessary for the image storage device to be held stationary during such exposure. It is also important that, during scanning of the image storage device to produce an image on the xerographic plate, the movement mentioned above of the scanning carriage 40 be synchronized with the movement of the xerographic plate 3. Since scanning of the image storage device 2 will be completed before the xerographic plate has moved past all the various processing stations, it is also desirable that the drive to the scanning carriage 40 be disengaged without interrupting the drive to the plate 3. In this way storage of a new image on the image storage device 2 can be initiated while the previous xerographic processing cycle is being completed. To this end, in accordance with this invention, the drive system of this machine permits such disengagement and a preferred embodiment as used in the illustrated machine is shown in FIGS. 4 and 5.

Figure 4:
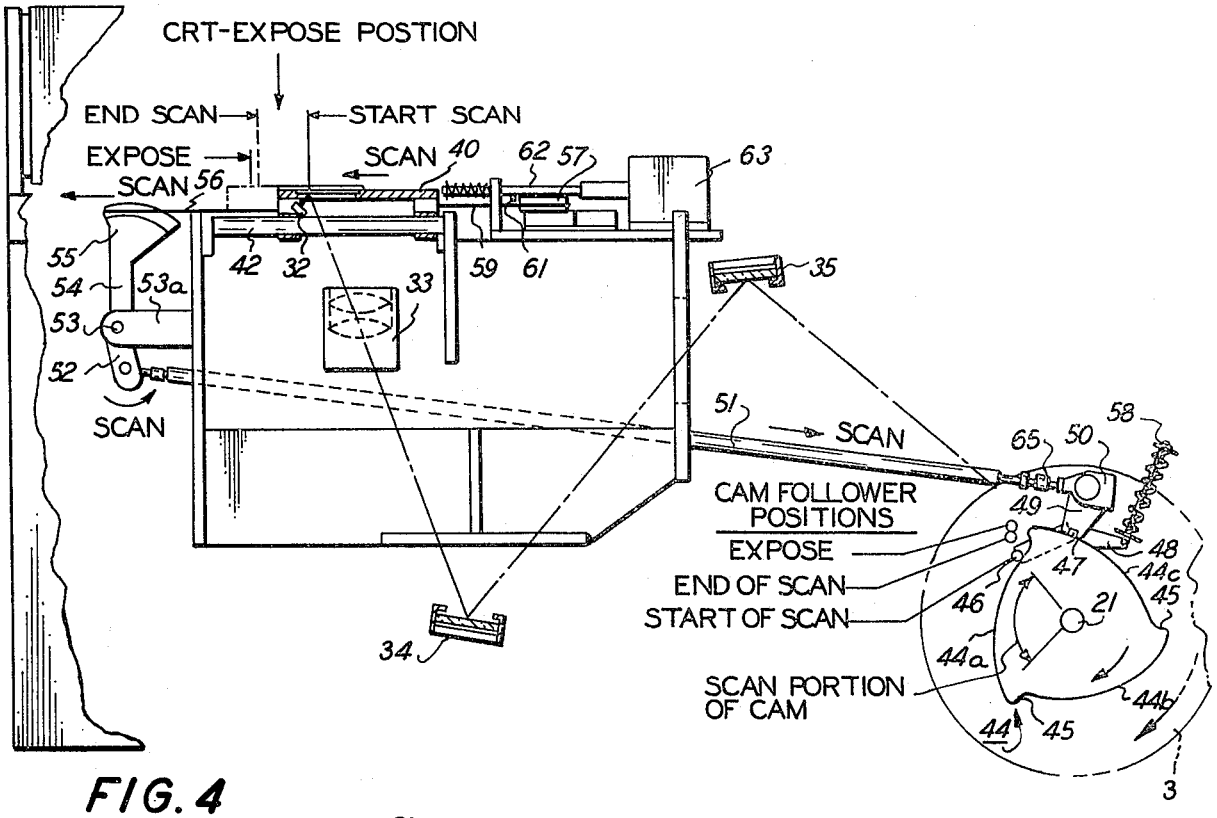
FIG. 4 shows, in side elevation, a preferred form of the scanning drive mechanism for the image storage device.
Figure 5:
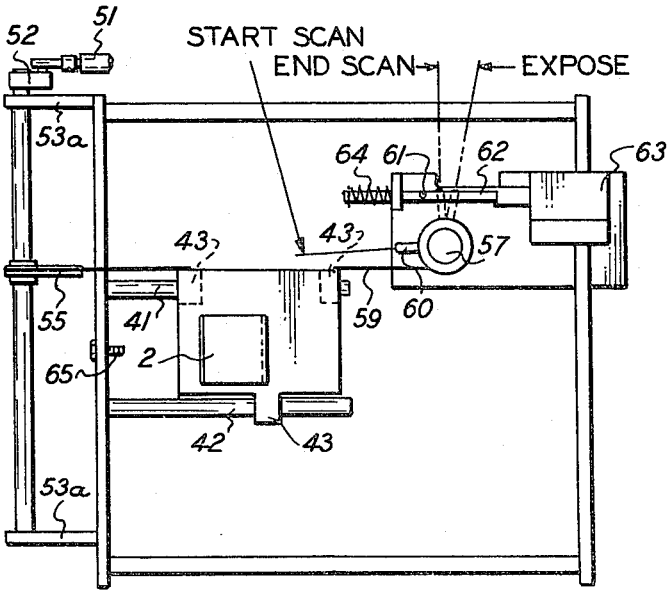
FIG. 5 is a plan view of the drive shown in FIG. 4; in part.

Referring now to FIGS. 4 and 5, the carriage 40 is mounted on the rails 41 and 42 by means of bearings 43. The carriage is accurately aligned and supported against movement relative to the rails by providing two bearings 43 on the rail 41 and a single bearing on the rail 43 arranged in triangular formation with the bearings 43 encircling the rails. The carriage 40 is driven from a cam 44. To ensure synchronous movement of the carriage 40 and the xerographic plate 3, the cam is mounted on the shaft 21 of the drum 3. In the illustrated embodiment the cam has three lobes 44*a*, 44*b* and 44*c* and the surface of each lobe defines a single scanning pass of the carriage 40. The steps 45 in the cam surface provide for quick rescan or return of the carriage 40 to the start-of-scan position.

The drive to the carriage 40 is taken from the cam 44 via a cam follower 46 mounted on a crank arm 47. The arm is secured to a shaft 48 arranged at its shoulder, the shaft 48 being rotatably mounted in the machine frame. A lever 49 secured to the shaft 48 extends generally upwardly at an angle to the arm 47. A yoke 50 at one end of a link 51 is pivotally connected to the free end of the lever 49. The other end of the link 51 to pivotally connected to the free end of a generally downwardly extending lever 52 secured on one end of a shaft 53. The shaft 53 is mounted for rotation in bearings in frame elements 53*a* and has secured thereto, in alignment with the carriage 40, a generally upwardly extending lever 54. The free end of the lever 54 takes the form of a segmented pulley 55. Attached to the pulley 55 is a cable 56 connected to one end of the scanning carriage 40. A tensioning bias is applied to the opposite end of the scanning carriage 40 by a spring mechanism 57 and the tension force urges the carriage to the start-of-scan position [to the right in FIGS. 4 and 5] at the same time urging the cam follower 46 against the cam 44, overriding the force applied by a compression spring 58 applied against the free end of the arm 47.

The spring mechanism 57 takes the form of a negator spring motor assembly which is attached to the carriage 40 by a cable 59. The motor assembly comprises a leaf spring wound several turns around a pin to which the inner end of the spring is attached, the opposite end of the spring being attached to the cable 59. The motor also includes a lever 60 connected to the spring so as to move clockwise in an arcuate path during scanning of the carriage between the positions identified in FIG. 5 which it adopts at the start-of-scan and end-of-scan positions of the carriage 40. During rescan of the carriage 40, the lever 60 returns along its arcuate path.

The purpose of the lever 60 will now be described. In its 'end-of-scan' position, the lever 60 is arranged in line with a pin 61 on the actuator shaft 62 of a solenoid device 63, which shaft 62 is biased to the left in FIGS. 4 and 5 by a spring 64. Actuation of solenoid 63 moves the actuator shaft 62 to the right so that, with the lever 60 in its 'end-of-scan' position, the pin 61 engages the lever and overdrives it beyond the 'end-of-scan' position (into the 'expose' position indicated) so as to lock out the negator spring 57 and cause a slack in the cable 59. This then allows the compression spring 58 to lift the cam follower 46 off the cam 44 and drive the scanning carriage 40 against a stop 65 which defines the expose position for the image storage device 2. Subsequent deactuation of the solenoid 63 releases the lever 60 reactivating the negator spring 57 and returning the cam follower 46 against the surface of the cam 44.

In order to avoid wear on the cam 44 caused by the cam follower 46 hitting it as it returns from its out-of-contact position, the reproduction machine should desirably be programmed so that the cam follower meets the cam at a high point on the cam surface, preferably between the end-of-scan position of the cam follower 46 and the rescan step 45. As will be seen the surface of each lobe 44*a*, 44*b* and 44*c* of the cam is slightly longer than required for scanning, for this purpose.

In order to permit adjustment of the carriage drive for proper scanning, either during set-up or to allow for wear, a suitable screw and nut arrangement 66 is provided for altering the length of the link.

Figure 6:
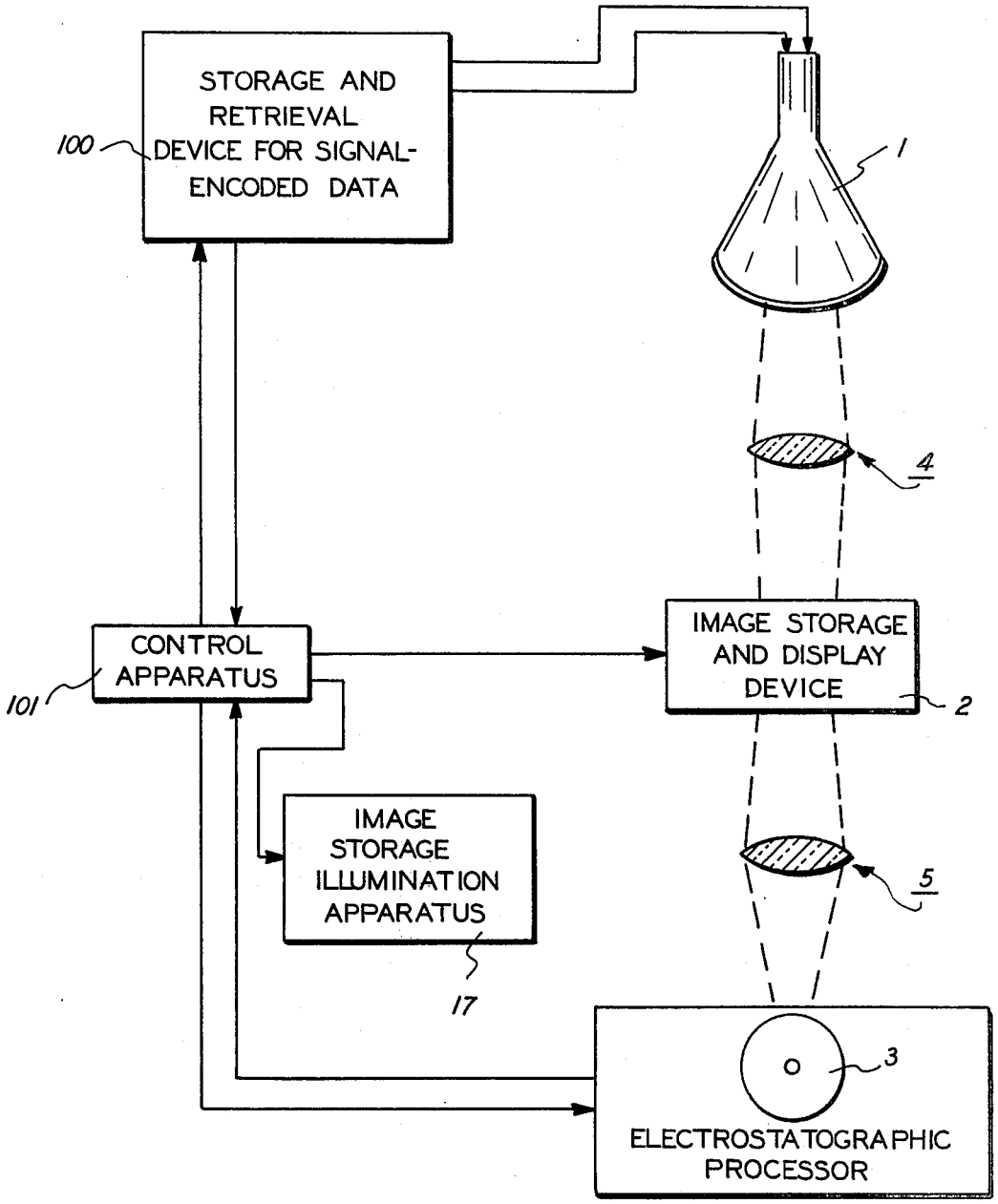
FIG. 6 is a schematic representation of one control system for use in the present invention.

Suitable programming systems for xerographic machines for controlling the sequence of operation of the processing steps are well known to those skilled in the art and suitable timing or delay circuitry may readily be provided to permit exposure of the image storage device 2 to the signal encoded image. However, the operation of the machine hereinabove described is most suitably controlled in response to signals received from the storage and retrieval device supplying the signal encoded data to the cathode ray display device 1. Such a control is schematically illustrated in FIG. 6. A storage and retrieval device 100 for the signal encoded image, suitably an FR-80 computer available from Information International Inc., having offices in Los Angeles, California, as part of their FR-80 Computer Printer System, is connected to the cathode ray oscilloscope 1 and is also connected via a suitable control apparatus 101 to the xerographic processor and to the image storage device 2 and its illumination source 17. The control apparatus 101 may be generally as described in copending application No. 591,800 aforesaid suitably modified to provide for actuation of the solenoid 63. By suitably programming the computer 100, it may serve to control and initiate all the processing steps of the reproduction machine in timed relationship to the data being supplied to the display device 1.

The operation of the machine described hereinabove under the control of the image storage and retrieval device 100 supplying data to the display device 1 will now be described. Initially, the computer 100 generates a signal to actuate the solenoid 63 so that the carriage 40 is moved to position the image storage device 2 for exposure to the display device 1. Next, the liquid crystal image storage device 2 is readied for receiving an image by clearing any opacity in the liquid crystal in the manner described previously. Voltage is now applied between the terminals 15 and 16 and signal encoded data supplied to the cathode ray oscilloscope 1. As the components of the signal encoded image are displayed on the screen, they are accumulated in the image storage device 2 via the optical exposure system 4. When all the components of the image have accumulated in the image storage device 2, the display device 1 is switched off as is the voltage applied across terminals 15 and 16. Now the solenoid 63 is deactuated to bring the cam follower 46 against the cam 44. Preferably, just prior to this, the xerographic drum 1 is put in motion and as explained previously, the deactuation of solenoid 63 is preferably timed so that the cam follower 46 returns to the cam surface at a high point between the end-of-scan position and the rescan step 45. The cam follower 46 moves down the rescan step 45, the carriage 40 returning to the start-of-scan position and the xerographic processing begins. As the carriage 40 moves along its scanning stroke, the lamp 32 is illuminated and a flowing image (of the image on the storage device 2) is formed on the plate 3 which has been charged by the charging device 23. The other xerographic processing stations are actuated to develop the latent electrostatic image formed on the plate 3 and to transfer to and fix the image on a sheet of paper which is fed out of the machine into the tray 29. This cycle may be repeated until the required number of copies has been obtained. During the final cycle, immediately the carriage 40 has reached its end-of-scan position the solenoid 63 is actuated to disengage the scanning drive and to move the image storage device 2 into the expose position. The image storage device 2 is now readied to receive another image. In the meantime the further processing of the final image on the xerographic plate 3 is being completed and the image storage device 2 may start receiving another signal encoded image displayed on the screen 1 before the final xerographic processing cycle is completed. The whole operation may be repeated as many times as required.

While a preferred embodiment of the invention has been described, it will be understood that various changes may be made and equivalents may be substituted for elements thereof without departing from the spirit and scope of the invention.

For example, while the preferred form of image storage device described above is a photoconductive-liquid crystal device, any other device capable of performing the same function of an intermediate image storage device may be used.

Also, while in the specific embodiment of scanning drive described above the spring mechanism 57 acts as a tension spring, any other spring mechanism acting either in tension or in compression may be utilized to perform the same function. Similarly by suitable rearrangement, compression spring 58 may be replaced by a tension spring. Furthermore, the operating speed of a xerographic reproduction machine in accordance with this invention may be increased by providing two (or more) separate scanning carriages, each carrying an image storage device and each driven from the cam by separate scanning drives as described herein, along with suitably modified optical projection systems. In this way while one image storage device is being exposed, the other may be imaged.

The photoconductive plate may take other forms than a drum. For example, it may take the form of a belt or may be carried on a substrate of paper and have the visible image developed thereon and directly fixed thereto.

What is claimed is:

1. Automatic electrostatographic reproduction apparatus for reproducing signal encoded images, comprising a display screen for a signal encoded image, an image storage device capable of temporarily storing and displaying an image projected thereon, a movable photoconductive member, means including first optical projection means for projecting an image displayed on said screen onto said image storage device such that said image is stored in said image storage device and displayed thereby in a form to which the photoconductive member is responsive, second optical projection means for projecting an image on the storage device onto said photoconductive member, first drive means for driving said photoconductive member, a carriage for the image storage device supported for reciprocating movement, second drive means operatively associated with said first drive means for driving said carriage in at least one direction in synchronism with said photoconductive member, means for disengaging said second drive means whereby the carriage may be rendered stationary without interrupting the drive to the photoconductive member, and means for positioning said carriage so that said image storage device is aligned with said first optical projection means upon disengagement of said second drive means, allowing the image storage device to be processed to receive an image by exposure to the display screen while processing of an image previously projected onto the photoconductive member is being completed.

2. Apparatus according to claim 1 wherein said second drive means includes control means, means for driving said control means in synchronism with said photoconductive member, said second drive means being disengageable intermediate the control means and the carriage, drive engaging means for maintaining said drive means engaged, said disengaging means being operable to deactivate said drive engaging means, and biasing means operable to disengage the drive means upon deactivation of said drive engaging means and to urge the carriage into a stationary position defined by said positioning means.

3. Apparatus according to claim 2 wherein the drive engaging means comprises biasing means of greater strength than said first-mentioned biasing means and acting in opposition thereto.

4. Apparatus according to claim 1 wherein said second drive means includes cam means, means for moving said cam means synchronously with said photoconductive plate, a cam follower drivingly connected to said carriage for controlling the movement thereof in response to movement of the cam means, first biasing means urging said cam follower against said cam means, second biasing means of lesser strength than said first biasing means urging said cam follower out of engagement with said cam means, and means for deactivating said first biasing means to permit said second biasing means to disengage said cam follower from said cam means and to urge the carriage into a stationary position defined by said positioning means.

5. Apparatus according to claim 4 wherein said photoconductive member has a continuous surface and is mounted for movement along a closed path and wherein said cam is mounted for rotation.

6. Apparatus according to claim 5 wherein said photoconductive member is in the form of a drum mounted for rotation on a shaft and said cam is secured on said shaft for rotation with the drum.

7. Apparatus according to claim 6 wherein said cam means has at least one first surface portion defining a movement of the carriage in said at least one direction in synchronism with the photoconductive member and at least one second surface portion defining a faster rescan movement of the carriage in the opposite direction.

8. Apparatus according to claim 5 wherein said cam has a first surface portion defining a scanning movement of said carriage in said at least one direction in synchronism with the photoconductive member, and a second surface portion defining a rescan movement of the carriage.

9. Apparatus according to claim 4 wherein said first biasing means comprises spring means and said deactivating means is operable to act upon said spring in opposition to the spring force to negate its effect.

10. Apparatus according to claim 9 wherein projection means associated with said first spring means is arranged for movement from a first to a second position during movement of said carriage in said at least one direction and the deactivating means is engageable with said projection means in said second position.

11. Apparatus according to claim 4 wherein said deactivating means includes a solenoid.

12. Apparatus according to claim 1 in combination with an image storage and retrieval apparatus for supplying signal encoded data to said display screen, wherein said means for disengaging the second drive means is signal responsive and said image storage and retrieval device is connected to said drive disengaging means to operate the latter.

13. Apparatus according to claim 1 wherein said photoconductive member is mounted for movement along a closed path and said second drive means includes a rotatable cam drivingly connected to said photoconductive member for rotational movement synchronously therewith, a cam follower drivingly connected to said carriage so as to control movement thereof in response to movement of the cam, said cam having at least one first surface portion defining a scanning movement of the carriage in one direction in synchronism with the movement of the photoconductive member and at least one second surface portion defining a faster rescan movement of the carriage in the opposite direction, first spring means urging said cam follower against the cam and urging the carriage in said opposite direction, second spring means, of lesser strength than said first spring means, urging said cam follower out of engagement with said cam and urging the carriage in said one direction, and means operable to act upon said first spring means in opposition to the spring force to deactivate the spring means so as to permit said second spring means to disengage the cam follower from the cam and urge the carriage in said one direction against a stop means without interrupting the movement of the photoconductive member.

14. Automatic electrostatographic reproduction apparatus of the kind in which, during operation, a photoconductive member is moved past a series of processing stations and during imaging a carrier for the image sought to be reproduced is moved in synchronism with the member, the improvement comprising a scanning drive for the image carrier comprising a carriage for the image carrier supported for reciprocating movement, cam means, means for moving said cam synchronously with said photoconductive member, a cam follower drivingly connected to said carriage for controlling movement thereof in response to movement of the cam means, whereby movement of the carriage in at least one direction is synchronized with the movement of the photoconductive member, first biasing means urging said cam follower against said cam means, second biasing means of lesser strength than said first biasing means urging said cam follower out of engagement with said cam means, and means for deactivating said first biasing means to permit said second biasing means to disengage said cam follower from the cam means whereby the carriage may be rendered stationary without interrupting the movement of the photoconductive member.

15. Apparatus according to claim 14 wherein said photoconductive member has a continuous surface and is mounted for movement along a closed path and wherein said cam is mounted for rotation.

16. Apparatus according to claim 15 wherein said photoconductive member is in the form of a drum mounted for rotation on a shaft and said cam is secured on said shaft for rotation with the drum.

17. Apparatus according to claim 16 wherein said cam means has at least one first surface portion defining a movement of the carriage in said at least one direction in synchronism with the photoconductive member and at least one second surface portion defining a faster rescan movement of the carriage in the opposite direction.

18. Apparatus according to claim 15 wherein said cam has a first surface portion defining a scanning movement of said carriage in said at least one direction in synchronism with the photoconductive member, and a second surface portion defining a rescan movement of the carriage.

19. Apparatus according to claim 14 wherein said first biasing means comprises spring means and said deactivating means is operable to act upon said spring in opposition to the spring force to negate its effect.

20. Apparatus according to claim 19 wherein projection means associated with said first spring means is arranged for movement from a first to a second position during movement of said carriage in said at least one direction and the deactivating means is engageable with said projection means in said second position.

21. Apparatus according to claim 14 wherein said deactivating means includes a solenoid.

22. Apparatus according to claim 14 in combination with an image storage device capable of temporarily storing and displaying, in a form to which the photoconductive member is responsive, an image projected thereon, said image storage member being supported on the carriage.

23. Apparatus according to claim 22 further including optical projection means for projecting onto said image storage device an image to be reproduced, such that said image is stored in said image storage device and displayed thereby.

24. Automatic electrostatographic reproduction apparatus of the kind in which, during operation, a photoconductive member is moved past a series of processing stations and during imaging a carrier for the image sought to be reproduced is moved in synchronism with the member, the improvement comprising a scanning drive for the image carrier comprising a carriage for the image carrier mounted for reciprocating movement, a photoconductive member mounted for movement along a closed path, a rotatable cam drivingly connected to said photoconductive member for rotational movement synchronously therewith, a cam follower drivingly connected to said carriage so as to control movement thereof in response to movement of the cam, said cam having at least one first surface portion defining a scanning movement of the carriage in one direction in synchronism with the movement of the photoconductive member, and at least one second surface portion defining a faster rescan movement of the carriage in the opposite direction, first spring means urging said cam follower against the cam and urging the carriage in said opposite direction, second spring means, of lesser strength than said first spring means, urging said cam follower out of engagement with said cam and urging the carriage in said one direction, and means operable to act upon said first spring means in opposition to the spring force to deactivate the spring means so as to permit said second spring means to disengage the cam follower from the cam and urge the carriage in said one direction against a stop means without interrupting the movement of the photoconductive member.

* * * * *

UNITED STATES PATENT AND TRADEMARK OFFICE

CERTIFICATE OF CORRECTION

PATENT NO. : 3,982,831

DATED : September 28, 1976

INVENTOR(S) : William Kingsley

It is certified that error appears in the above-identified patent and that said Letters Patent are hereby corrected as shown below:

In column 5, line 26, delete "reproduced.".

In column 5, line 33, delete "produced" and insert --reproduced--.

In column 6, line 41, delete "to" and insert --is--.

Signed and Sealed this

Fourteenth Day of December 1976

[SEAL]

*Attest:*

RUTH C. MASON
*Attesting Officer*

C. MARSHALL DANN
*Commissioner of Patents and Trademarks*